US005759293A

United States Patent [19]

Takahashi et al.

[11] Patent Number: 5,759,293

[45] Date of Patent: *Jun. 2, 1998

[54] DECARBURIZATION-ANNEALED STEEL STRIP AS AN INTERMEDIATE MATERIAL FOR GRAIN-ORIENTED ELECTRICAL STEEL STRIP

[75] Inventors: Nobuyuki Takahashi; Yasunari Yoshitomi; Tadashi Nakayama; Yoshiyuki Ushigami, all of Kitakyusyushi, Japan

[73] Assignee: Nippon Steel Corporation, Tokyo, Japan

[ * ] Notice: The term of this patent shall not extend beyond the expiration date of Pat. No. 5,266,129.

[21] Appl. No.: 554,531

[22] Filed: Nov. 6, 1995

Related U.S. Application Data

[63] Continuation of Ser. No. 341,959, Nov. 16, 1994, abandoned, which is a continuation of Ser. No. 46,901, Apr. 15, 1993, which is a continuation of Ser. No. 734,293, Jul. 17, 1991, abandoned, which is a continuation-in-part of Ser. No. 663,205, Feb. 28, 1991, abandoned, which is a continuation of Ser. No. 461,123, Jan. 4, 1990, abandoned.

[30] Foreign Application Priority Data

Jan. 7, 1989 [JP] Japan ..... 1-1778

[51] Int. Cl.[6] ..... H01F 1/04

[52] U.S. Cl. ..... 148/111; 148/112; 148/226

[58] Field of Search ..... 148/111, 112, 148/217, 226

[56] References Cited

U.S. PATENT DOCUMENTS

| | | | |
|---|---|---|---|
| 3,415,696 | 12/1968 | Gimigliano | 148/110 |
| 3,841,924 | 10/1974 | Sakakura et al. | 148/110 |
| 3,976,517 | 8/1976 | Blank et al. | 148/112 |
| 3,990,924 | 11/1976 | Matsumoto et al. | 148/112 |
| 4,160,681 | 7/1979 | Miller | 148/111 |
| 4,439,252 | 3/1984 | Iwamoto et al. | 148/110 |
| 4,517,032 | 5/1985 | Goto et al. | 148/112 |
| 4,579,608 | 4/1986 | Shimizu et al. | 148/111 |
| 4,623,406 | 11/1986 | Suga et al. | 148/111 |
| 4,692,193 | 9/1987 | Yoshitomi | 148/111 |
| 4,718,951 | 1/1988 | Schoen | 148/111 |
| 4,753,692 | 6/1988 | Kuroki et al. | 148/111 |
| 4,773,948 | 9/1988 | Nakaoka et al. | 148/111 |
| 4,797,167 | 1/1989 | Nakayama et al. | 148/111 |
| 4,806,176 | 2/1989 | Harase et al. | 148/111 |
| 4,824,493 | 4/1989 | Yoshitomi et al. | 148/111 |
| 4,888,066 | 12/1989 | Yoshitomi et al. | 148/113 |
| 4,937,909 | 7/1990 | Mori et al. | 148/110 |
| 4,938,807 | 7/1990 | Takahashi et al. | 148/111 |
| 4,979,997 | 12/1990 | Kobayashi et al. | 148/111 |
| 4,992,114 | 2/1991 | Nakashima et al. | 148/111 |
| 5,141,573 | 8/1992 | Nakashima | 148/111 |
| 5,145,533 | 9/1992 | Yoshitomi et al. | 148/111 |
| 5,186,762 | 2/1993 | Ushigami et al. | 148/111 |
| 5,266,129 | 11/1993 | Minakuchi et al. | 148/111 |

FOREIGN PATENT DOCUMENTS

| | | | |
|---|---|---|---|
| 851066 | 10/1960 | United Kingdom | 148/110 |
| 943448 | 12/1963 | United Kingdom | 148/112 |
| 1063046 | 3/1967 | United Kingdom | 148/112 |
| 2101631 | 1/1983 | United Kingdom | 148/112 |

OTHER PUBLICATIONS

Ushigami, Y., et al., "Influence of Primary Recrystallized Structure on Secondary Recrystallization in Fe-3% Si Alloy", *Materials Science Forum*, vols 204–206, part 2 (1996), pp. 623–628.

*Primary Examiner*—George Wyszomierski
*Attorney, Agent, or Firm*—Wenderoth, Lind & Ponack

[57] ABSTRACT

A decarburization-annealed steel strip as an intermediate material for grain-oriented electrical steel strip having good secondary recrystallization and excellent electrical properties is provided by causing a steel strip to possess a microstructure in which the primary recrystallization grains have an average diameter $\bar{d}$ of not less than 15 μm and a coefficient of diameter deviation σ* of not more than 0.6.

1 Claim, 3 Drawing Sheets

DECARBURIZATION-ANNEALED STEEL STRIP AS AN INTERMEDIATE MATERIAL FOR GRAIN-ORIENTED ELECTRICAL STEEL STRIP

This application is a continuation of now abandoned application Ser. No. 08/341,959, filed Nov. 16, 1994 ,which is a continuation of now abandoned application Ser. No. 08/046,901, filed Apr. 15, 1993, which application is a continuation of now abandoned application Ser. No. 07/734,293, filed Jul. 17, 1991, which application is a continuation-in-part of now abandoned application Ser. No. 07/663,205, filed February 28, 1991, which application is a continuation of now abandoned application Ser. No. 07/461,123, filed Jan. 4, 1990.

BACKGROUND OF THE INVENTION

1. Field of the Invention

This invention relates to a decarburization-annealed steel strip as an intermediate material for grain-oriented electrical steel strip.

2. Description of the Prior Art

Grain-oriented electrical steel strip is used primarily in the cores of transformers and other electric equipment and is required to exhibit superior magnetic properties, specifically superior excitation property and core loss property. Excitation property is generally expressed in terms of the magnetic flux density $B_8$in a magnetic field of an intensity of 800A/m. On the other hand, core loss property is ordinarily expressed as the amount of electric power loss per unit weight $W_{17}/_{50}$ (w/kg) occurring due to conversion of electric power to heat in an iron core placed in a 50Hz, 1.7Tesla alternating magnetic field.

The core loss property of grain-oriented electrical steel strip is affected more strongly by the flux density than any other factor. Generally speaking, the core loss property improves (the core loss value decreases) in proportion as the flux density increases. On the other hand, in the production of a grain-oriented electrical steel strip of high flux density, it is generally found that the core loss property is degraded by the occurrence of enlarged secondary recrystallization grains. However, when magnetic domain control for subdividing the magnetic domain width is conducted in respect of such a high flux density grain-oriented electrical steel strip, it is possible to dramatically improve the core loss property of the strip (realize low core loss) notwithstanding the size of the secondary recrystallization grains.

Grain-oriented electrical steel strip is produced by a method which involves causing secondary recrystallization grains to appear and grow during final annealing, thus promoting the development of a Goss structure having its (110) plain within the strip surface and its <001>axis in the rolling direction. For obtaining grain-oriented electrical steel strip with good electrical properties, it is necessary to achieve a high degree of alignment of the easily magnetizable axis of <001>orientation with the rolling direction of the steel strip. The orientation of the secondary recrystallization grains can be greatly improved and the core loss property dramatically enhanced by causing fine precipitates of MnS, AlN etc. to function as inhibitors and by adopting a production process including final high-reduction cold rolling.

Since each step of the grain-oriented electrical steel strip production process includes various factors affecting the electrical properties of the product, it is the practice to establish extremely strict standards for the production conditions in the individual steps. Notwithstanding that a large amount of work goes into production control for observing these standards, it is found that some of the products are, for no apparent reason, inferior in secondary recrystallization or in electrical properties. If it should be possible to predict the occurrence of products inferior in secondary recrystallization or electrical properties in the course of the production process, this would make it possible to eliminate problems stemming from the production conditions, the properties of the steel, the surface condition of the steel and the like, and thus to design a grain-oriented electrical steel production process enabling production under conditions that ensure products exhibiting good secondary recrystallization and excellent electrical properties. In spite of various attempts to make such prediction possible, however, it has so far been difficult to make a forecast in the course of production as to when products inferior in secondary recrystallization or electrical properties will occur.

SUMMARY OF THE INVENTION

An object of this invention is to provide a decarburization-annealed steel strip as an intermediate material for a grain-oriented electrical steel strip having superior magnetic properties, specifically superior exitation property and core loss property.

For achieving this object, the invention provides a decarburization-annealed steel strip which possesses a micro-structure in which the primary recrystallization grains have an average diameter $\bar{d}$ of not less than 15μm and a coefficient of diameter deviation σ* (standard deviation of distribution normalized by the average diameter $\bar{d}$ ) of not more than 0.6.

DETAILED DESCRIPTION OF THE PREFERRED EMBODIMENT

The decarburization-annealed steel strip according to this invention is produced by preparing a steel melt in accordance with the conventional steelmaking method; forming the melt into a slab either by continuous casting or by casting the melt into a mold, allowing it to solidify and then soaking and slabbing the result; hot rolling the slab, with or without reheating, into a hot-rolled strip; optionally subjecting the hot-rolled strip to annealing; cold rolling the strip to the final thickness by two or more cold rollings with intermediate annealing; and then subjecting the result to decarburization annealing.

Focusing on the micro-structure of the steel strip following decarburization annealing (referred to hereinafter as the "decarburization-annealed strip" ), the inventors conducted a broad and multifaceted investigation of the relationship between the micro-structure of the decarburization-annealed strip and the electrical properties (magnetic flux density) of the final product made from the above-mentioned decarburization-annealed strip. As a result, they discovered that there is a very close relationship between the micro-structure of the decarburization-annealed strip (intermediate material) and the electrical properties (magnetic flux density) of the final product. This will now be explained with reference to experimental results.

Figure 1:
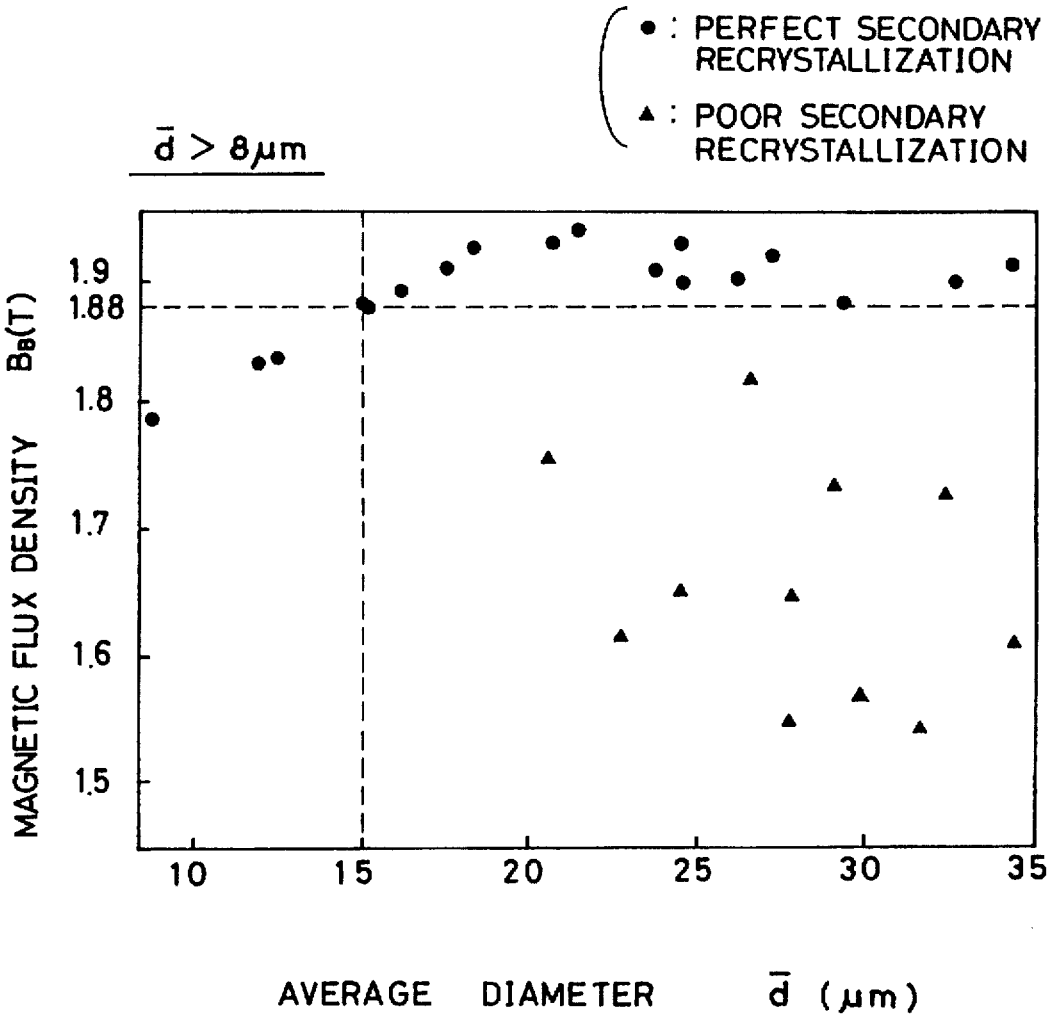
FIG. 1 is a graph showing the effect on final product magnetic flux density ($B_8$value) of the average diameter $\bar{d}$ of the primary recrystallization grains of the steel strip (intermediate material) following decarburization annealing.
Figure 2:
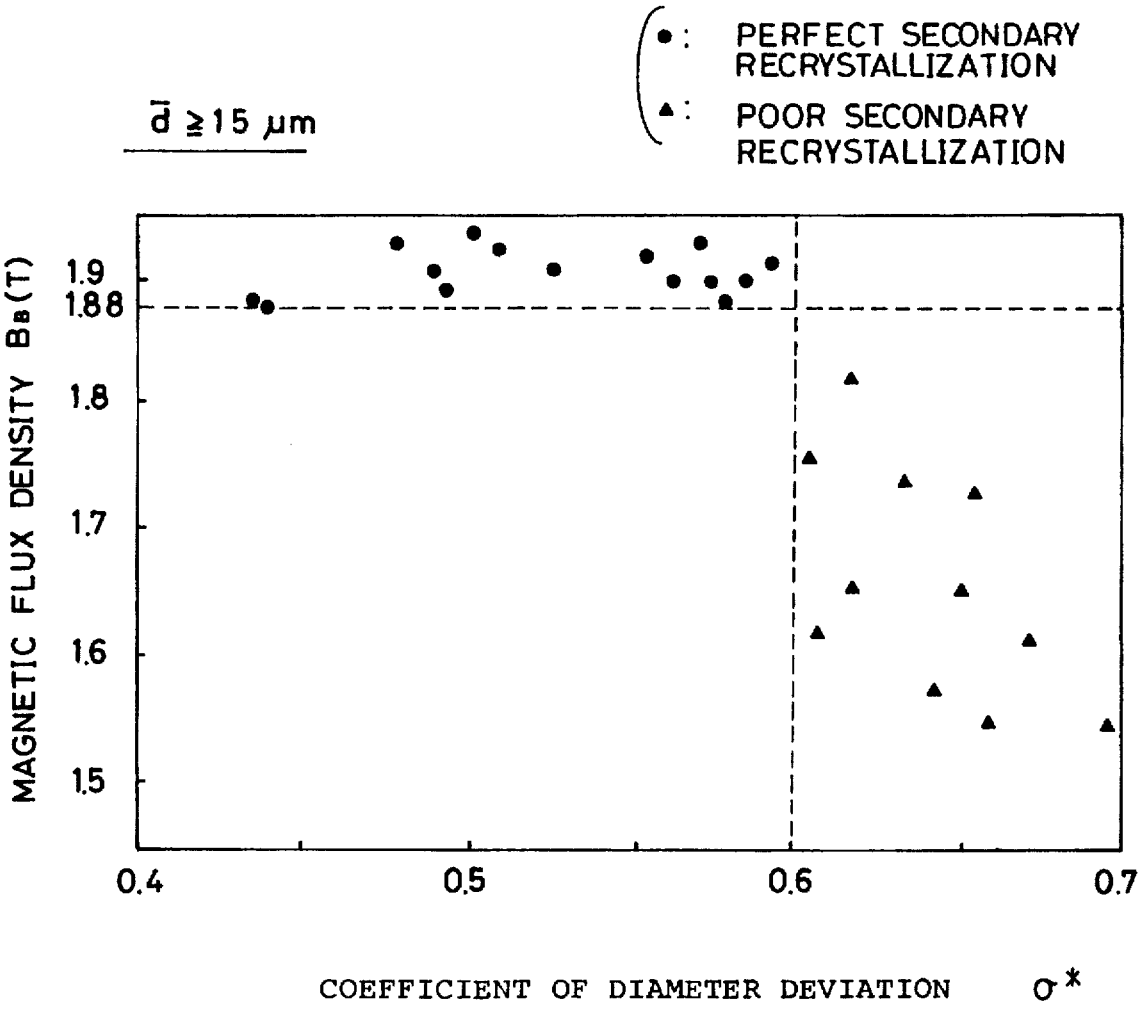
FIG. 2 is a graph showing the effect on final product magnetic flux density ($B_8$value) of the coefficient of diameter deviation σ* of the primary recrystallization grains of the steel strip (intermediate material) following decarburization annealing.

FIGS. 1 and 2 show the effect on the final product magnetic flux density ($B_8$value) of the average diameter $\bar{d}$ (circular equivalent) and coefficient of diameter deviation $\sigma^*$ of the primary recrystallization grains, as determined by image-analyzing the micro-structure of decarburization-annealed strips (intermediate material) (over full sections taken normal to the rolling direction) by use of an optical microscope.

Figure 3:
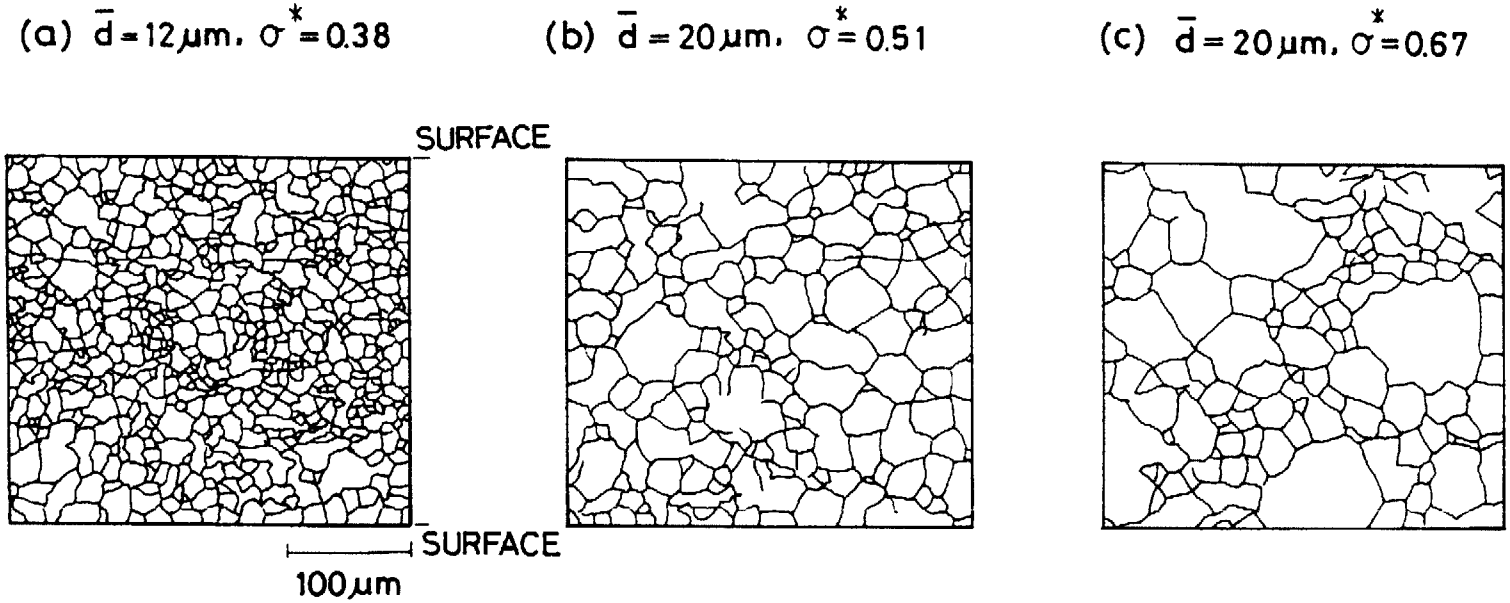
FIG. 3 shows micrographs of the micro-structure of different steel strips at the stage following decarburization annealing but wherein the primary recrystallization grains have different average diameters $\bar{d}$ and coefficients of diameter deviation σ*.

FIG. 3 shows the micro-structures over full sections normal to the rolling direction of decarburization-annealed strips having primary recrystallization grains of differing average diameter $\bar{d}$ and coefficient of diameter deviation $\sigma^*$.

These decarburization-annealed strips were produced by preparing a slab consisting of, in weight-percent, 0.020 –0.090% C,3.2 –3.3% Si,0.010 –0.045% acid-soluble Al, 0.0030 –0.0100% N, 0.0030 –0.0300% S, 0.070 –0.500% Mn and the balance of Fe and unavoidable impurities, heating the slab within the temperature range of 1150 –1400° C, hot rolling the heated slab into a 2.3mm thick hot-rolled strip, annealing the hot-rolled strip at a temperature in the range of 900°–1200° C, cold rolling the annealed strip into a 0.285mm-thick cold-rolled strip by cold rolling including a final cold rolling step with a heavy reduction ratio of about 88%, subjecting the cold-rolled strip to decarburization annealing at a temperature in the range of 830°–1000° C.

As is clear from FIGS. 1 and 2, when the average diameter $\bar{d}$ of the primary recrystallization grains of the decarburization-annealed steel strip is not less than 15μm ( $\bar{d} \geqq 15\mu m$ ) and the coefficient of diameter deviation $\sigma^*$ thereof is not more than 0.6($\sigma^* \leqq 0.6$), the product made from the above-mentioned steel strip exhibits a high magnetic flux density ($B_8$) value of not less than 1.88Tesla ($B_8 \geqq 1.88$Tesla). These same figures moreover indicate that it is possible to obtain a final product with good secondary recrystallization and electrical properties by causing the average diameter $\bar{d}$ and coefficient of diameter deviation $\sigma^*$ of the primary recrystallization grains of the decarburization-annealed steel strip to fall within appropriate ranges.

The reason for the relationships indicated in FIGS. 1 and 2, specifically why the average diameter $\bar{d}$ and coefficient of diameter deviation $\sigma^*$ of the primary recrystallization grains of the decarburization-annealed strip have an effect on the quality of the secondary recrystallization in the final annealing step and on the magnetic flux density ($B_8$) value of the final product made from said steel strip, is not entirely clear. The inventors surmise, however, that the reason is as follows.

Factors having an effect on the various aspects of secondary recrystallization of the final product, one of which is the orientation of the secondary recrystallization grains, include the micro-structure (average diameter and grain diameter distribution), the texture and the inhibitor strength of the decarburization-annealed strip. As the texture and the grain diameter distribution change with grain growth following completion of primary recrystallization, the average grain diameter indirectly indicates the micro-structure and diameter distribution.

Moreover, the average diameter of the primary recrystallization grains of the decarburization-annealed strip is itself inversely proportional to the sum of the grain boundary areas (per unit area) and the intergranular energy provides the driving force for the growth of secondary recrystallization grains. It is therefore thought that the average diameter of the primary recrystallization grains of the decarburization-annealed steel strip has an effect on the secondary recrystallization during the final annealing step and, as such, can be considered to be a parameter simultaneously encompassing the texture, diameter distribution and grain boundary area of the decarburization-annealed steel strip.

The texture represents the quantitative ratio among the grains oriented in the direction in which secondary recrystallization occurs (grains with {110 } <001>orientation etc.), the grains oriented in the direction in which the secondary recrystallization grains can be readily caused to grow (grains with {111 }<112>orientation etc.) and grains oriented in other directions. On the other hand, the grain diameter distribution affects the nucleation of secondary recrystallization grains and the uniformity/non-uniformity of secondary recrystallization grain growth, while the sum of the grain boundary areas affects the nucleation of secondary recrystallization grains and the ease with which the secondary recrystallization grains grow. It is therefore thought that, as a parameter simultaneously encompassing the texture, grain diameter distribution and grain boundary area, the average diameter $\bar{d}$ of the primary recrystallization grains of the decarburization-annealed strip is strongly correlated with the orientation of the secondary recrystallization grains.

On the other hand, the coefficient of diameter deviation $\sigma^*$ of the primary recrystallization grains of the decarburization-annealed strip indicates the degree of grain non-uniformity and the larger its value, the less readily do secondary recrystallization grains nucleate and the secondary recrystallization grains grow. A large coefficient of diameter deviation $\sigma^*$ is therefore thought to lead to inferior secondary recrystallization. Thus the coefficient of diameter deviation $\sigma^*$ of the primary recrystallization grains of the decarburization-annealed strip is closely related to the occurrence of inferior secondary recrystallization, while, in cases where the secondary recrystallization is good, the average diameter $\bar{d}$ of the primary recrystallization grains of the decarburization-annealed strip is closely related to the magnetic flux density of the final product.

Therefore, by controlling the average diameter $\bar{d}$ and coefficient of diameter deviation $\sigma^*$ of the primary recrystallization grains of the decarburization-annealed strip so that these two parameters fall within prescribed ranges, it becomes possible to produce products (grain-oriented steel strips) with a high magnetic flux density ($B_8$) value at high yield.

A preferred producing method of the intermediate material according to the present invention is as follows:

From the point of stabilizing the magnetic flux density of the final product, the slab should preferably contain, in weight percent, 0.025 –0.100% C and 2.5 –4.5% Si. As inhibitor-forming elements it is possible to include Al, N, Mn, S, Se, Sb, B, Cu, Bi, Nb, Cr, Sn, Ti and the like.

For reducing energy costs, it is preferable to heat the slab to a temperature not exceeding 1300° C. The heated slab is hot rolled to obtain a hot-rolled strip.

The hot-rolled strip, either as it is or, if necessary, after annealing, is then cold rolled to the final thickness by two or more cold rollings with intermediate annealing. For increasing the magnetic flux density ($b_8$value) of the final product, it is preferable set the reduction ratio in the final cold rolling step at not less than 80%.

Setting the reduction ratio in the final cold rolling step at not less than 80% makes it possible to obtain appropriate amounts of {110 } <001> oriented grains which are sharp and coincident orientation grains, and ({111 } <112> oriented grains or the like) which are likely to be eroded by the aforementioned oriented grains.

The cold-rolled strip of final thickness is subjected to decarburization annealing.

The resulting decarburization-annealed steel strip (intermediate material for grain-oriented electrical steel strip) according to the invention has to be imparted with an average primary recrystallization grain diameter $\bar{d}$ of not less than 15μm and a coefficient of primary recrystallization diameter deviation σ* of not more than 0.6.

There is no particular limitation on the method to be used for controlling the micro-structure so as to ensure that the primary recrystallization grains of the decarburization-annealed strip have an average diameter $\bar{d}$ of not less than 15μm and a coefficient of deviation σ* of not more than 0.6. It is possible for example to use the reduction ratio during the cold rolling step and the grain diameter of the steel prior to cold rolling as operational parameters for adjusting the number of primary recrystallization nuclei, or to use the content range of inhibitor-forming elements, the slab heating temperature, the strip coiling temperature in the hot rolling step and the temperature in the hot-rolled strip annealing step as operational parameters for adjusting the inhibitor strength during decarburization annealing and thus controlling grain growth, or to use the temperature-time relationship in the decarburization annealing step as a parameter for controlling growth of the primary recrystallization grains. It is moreover possible to satisfy the aforesaid micro-structure conditions (the average grain diameter and the coefficient of grain diameter deviation σ*) by subjecting the steel strip to additional annealing between the decarburization annealing step and the final annealing step.

There are no particular restrictions on the composition of the annealing separation agent or the final annealing conditions.

For ensuring that the appropriate micro-structure of the decarburization-annealed strip does not become inappropriate owing to grain growth during the temperature increase phase of the final annealing step it is advantageous from the point of stabilizing production to increase the inhibitor strength in the temperature increase phase of the final annealing step, by, for example, subjecting the steel strip to nitriding treatment or sulfiding treatment.

In the case of subjecting the steel strip to decarburization annealing in a relatively low temperature range (not more than 800° C.), it is necessary for satisfying the aforesaid micro-structure conditions (average diameter and grain diameter deviation) to reduce the inhibitor strength during the annealing. When this results in the inhibitor strength becoming so low as to hinder stable appearance and development of secondary recrystallization grains during the final annealing step, it then becomes necessary, as just explained, to increase the inhibitor strength in the temperature increase phase of the final annealing step, by, for example, subjecting the steel strip to nitriding treatment or sulfiding treatment. In a steel strip containing Al it is possible to achieve inhibitor strengthening by increasing the nitrogen partial pressure of the atmosphere during the temperature increase phase of the final annealing step since this will cause more nitrogen to penetrate the steel strip and combine with Al to form AlN.

As will be clear from FIGS. 1 and 2, the reason the invention limits the average diameter $\bar{d}$ of the primary recrystallization grains of the decarburization-annealed strip to not less than 15μm and the coefficient of deviation σ* of the diameter thereof to not more than 0.6is that when the average diameter and coefficient of deviation are within these ranges it becomes possible to obtain a grain-oriented electrical steel strip which is a product exhibiting outstanding properties, specifically a magnetic flux density ($B_8$) value of 1.88Tesla or more.

Although no particular upper limit is placed on the average diameter $\bar{d}$ of the primary recrystallization grains of the decarburization-annealed strip, in the case of a decarburization-annealed strip of ordinary composition produced under ordinary processing conditions, the upper limit of the average diameter $\bar{d}$ of the primary recrystallization grains is 50μm. For obtaining a decarburization-annealed strip whose primary recrystallization grains have an average diameter $\bar{d}$ of greater than 50μm it is necessary to purify the steel to a high degree and also, for example, to increase the temperature in the decarburization annealing step. Both of these measures are undesirable because they increase production costs.

On the other hand, it is permissible for the coefficient of diameter deviation σ* of the primary recrystallization grains of the decarburization-annealed strip to be as low as zero.

The condition of the primary recrystallization grains of the decarburization-annealed strip is prescribed in this way so that even if the micro-structure of the decarburization-annealed strip should be inappropriate, it will still be possible to obtain a final product with good electrical properties by subjecting the strip to additional annealing between the decarburization annealing step and the final annealing step so as to adjust the average diameter $\bar{d}$ and the coefficient of diameter deviation σ* of the primary recrystallization grains of the decarburization-annealed strip to fall in the ranges of not less than 15μm and not more than 0.6, respectively.

EXAMPLES

Example 1

A slab containing 0.054wt% C, 3.25wt% Si, 0.15wt% Mn, 0.005wt% S, 0.027wt% acid-soluble Al and 0.0078wt% N was heated to 1150° C and hot rolled into a 2.3mm hot-rolled strip. After being annealed at 1150° C. or 900° C., the hot-rolled strip was cold rolled to final thickness of 0.285mm at a reduction ratio of 88%. The resulting cold-rolled strip was decarburization annealed by holding at 810° C. for 150 seconds and then at 830 C., 890° C or 950° C. for 20seconds. The decarburization-annealed strip was coated with an annealing separation agent consisting mainly of MgO and was then subjected to final annealing by heating to 1200° C. at the rate of 10° C./hr in an atmosphere of 25% $N_2$and 75% $H_2$followed by holding at 1200° C. for 20 hours in a 100% $H_2$atmosphere.

Following the decarburization annealing, an image analyzer was used to measure the average diameter $\bar{d}$ and the coefficient of diameter deviation σ* over the full sectional thickness of each decarburization-annealed strip. Table 1shows the results of the image analysis and the magnetic flux density of the final products made from the decarburization annealed strip.

TABLE 1

| Hot rolled strip annealing temp. (°C.) | Decarburization annealing temp. (°C.) | Average diameter $\bar{d}$ (μm) | Coefficient of diameter deviation (σ*) | Flux density $B_8$(T) | Secondary recrystallization ratio (%) | Remarks |
|---|---|---|---|---|---|---|
| 1150 | 830 | 13 | 0.45 | 1.85 | 100 | Comparison |
| 1150 | 890 | 19 | 0.48 | 1.92 | 100 | Invention |
| 1150 | 950 | 23 | 0.53 | 1.92 | 100 | " |
| 900 | 830 | 18 | 0.47 | 1.92 | 100 | " |
| 900 | 890 | 23 | 0.52 | 1.93 | 100 | " |
| 900 | 950 | 30 | 0.62 | 1.68 | 30 | Comparison |

Example 2

A slab containing 0.058wt% C, 3.28wt% Si, 0.14wt% Mn, 0.007wt% S, 0.025wt% acid-soluble Al and 0.0075wt.% N was heated to 1150° C. or 1250° C. and hot rolled into a 2.3mm hot-rolled strip. The hot-rolled strip was annealed by holding at 1150° C. for 30seconds followed by holdingg at 900° C. for 30seconds and was then cold rolled to a thickness of 0.285mm at a reduction ratio of about 88%The resulting cold-rolled strip was decarburization annealed by holding at 850° C. for 150seconds.

The decarburization-annealed strip was coated with an annealing separation agent consisting mainly of MgO and was then subjected to final annealing by rapid heating to 1200° C. at the rate of 10° C./hr in an atmosphere of 25% $N_2$and 75% $H_2$followed by holding at 1200° C. for 20hours in a 100% $H_2$atmosphere.

Following the decarburization annealing, an image analyzer was used to measure the average diameter $\bar{d}$ and the coefficient of diameter deviation σ* over the full sectional thickness of each decarburization-annealed strip. Table 2shows the processing condition, the results of the image analysis and the magnetic flux density of the final products made from the decarburization annealed strip.

TABLE 2

| Slab heating temp. (°C.) | Average diameter $\bar{d}$ (μm) | Coefficient of diameter deviation σ* | Flux density $B_8$(T) | Secondary recrystallization ratio (%) | Remarks |
|---|---|---|---|---|---|
| 1150 | 21 | 0.49 | 1.93 | 100 | Invention |
| 1250 | 14 | 0.44 | 1.87 | 100 | Comparison |

Example 3

The decarburization-annealed strip obtained from the slab heated to 1250° C. in Example 2was heat treated at 950° C. for 30seconds, coated with an annealing separation agent consisting mainly of MgO and was then subjected to final annealing under the conditions of Example 2.

Table 3shows the average diameter $\bar{d}$ and the coefficient of diameter deviation σ* over the full sectional thickness of two such decarburization-annealed strips, one which was subjected to addition annealing in accordance with this invention and one which was not. The flux density $B_8$etc. of the final products are also shown.

TABLE 3

| With/without additional annealing | Average diameter $\bar{d}$ (μm) | Coefficient of diameter deviation σ* | Flux density $B_8$(T) | Secondary recrystallization ratio (%) | Remarks |
|---|---|---|---|---|---|
| Without | 14 | 0.45 | 1.87 | 100 | Comparison |
| With | 18 | 0.49 | 1.92 | 100 | Invention |

Example 4

A slab containing 0.056wt% C, 3.27wt% Si, 0.14wt% Mn, 0.006wt% S, 0.027wt% acid-soluble Al and 0.0078wt% N was heated to 1150° C. and hot rolled into a 2.0mm hot-rolled strip. The hot-rolled strip was annealed by holding at 1120° C. for 30seconds followed by holding at 900° C. for 30 seconds and was then cold rolled to a thickness of 0.220mm at a reduction ratio of 89%. The resulting cold-rolled strip was decarburization annealed by holding at 830° C. for 90seconds followed by holding at 890° C. or 920° C. for 20seconds. The so-obtained decarburization-annealed strip was coated with an annealing separation agent consisting mainly of MgO and was then subjected to final annealing by heating to 880° C. in an atmosphere of 25% $N_2$and 75% $H_2$and then from 880° C. to 1200° C. in an atmosphere of 75% $N_2$and 25% $H_2$, followed by holding at 1200° C. for 20hours in a 100% $H_2$atmosphere.

The temperature increase rate up to 1200° C. was 10° C./hr or 25° C./hr.

Following the decarburization annealing, an image analyzer was used to measure the average diameter $\bar{d}$ and the coefficient of diameter deviation σ* over the full sectional thickness of each decarburization-annealed strip. Table 4shows the processing conditions, the results of the image analysis and the magnetic flux density of the final products made from the decarburization annealed strip.

TABLE 4

| Decarburization annealing temp. (°C.) | Temp. increase rate °C./hr | Average diameter $\bar{d}$ (μm) | Coefficient of diameter deviation σ* | Flux density $B_8$(T) | Secondary recrystallization ratio (%) | Remarks |
|---|---|---|---|---|---|---|
| 890 | 10 | 22 | 0.55 | 1.94 | 100 | Invention |
| 890 | 25 | 22 | 0.55 | 1.93 | 100 | Invention |
| 920 | 10 | 25 | 0.61 | 1.73 | 52 | Comparison |
| 920 | 25 | 25 | 0.61 | 1.70 | 40 | Comparison |

Example 5

Each decarburization-annealed strip obtained under the conditions of Example 4was coated with an annealing separation agent consisting mainly of MgO and was then subjected to final annealing by heating to 1200° C. at the rate of 15° C./hr in an atmosphere of 25% $N_2$and 75% $H_2$or in an atmosphere of 50% $N_2$and 50% $H_2$, followed by holding at 1200° C. for 20hours in a 100% $H_2$atmosphere.

Following the decarburization annealing, an image analyzer was used to measure the average diameter $\bar{d}$ and the coefficient of diameter deviation σ* over the full sectional thickness of each decarburization-annealed strip. Table 5shows the processing conditions, the results of the image analysis and the magnetic flux density of the final products made from the decarburization annealed strip.

TABLE 5

| Decarburization annealing temp. (°C.) | Atmospheric gas $N_2/H_2$ | Average diameter $\bar{d}$ (μm) | Coefficient of diameter deviation σ* | Flux density $B_8$(T) | Secondary recrystallization ratio (%) | Remarks |
|---|---|---|---|---|---|---|
| 890 | 25/75 | 22 | 0.55 | 1.93 | 100 | Invention |
| 890 | 50/50 | 22 | 0.55 | 1.92 | 100 | Invention |
| 920 | 25/75 | 25 | 0.61 | 1.71 | 43 | Comparison |
| 920 | 50/50 | 25 | 0.61 | 1.79 | 58 | Comparison |

Example 6

A slab containing 0.045wt% C., 3.20wt% Si, 0.065wt% Mn, 0.023wt% S, 0.08wt% Cu and 0.018wt% Sb was heated to 1300° C. and hot rolled into a 2.6mm hot-rolled strip. The hot-rolled strip was held at 900° C. for 3minutes for annealing and then cold rolled to 0.95mm at a reduction ratio of 63%. The resulting cold-rolled strip was held for 950° C. for 3minutes for intermediate annealing and then cold rolled to a final thickness of 0.285mm at a reduction ratio of 70%.

The so-obtained cold-rolled strip was decarburization annealed for 200seconds at 810° C., 850° C. or 890° C. The decarburization annealed strip was coated with an annealing separation agent consisting mainly of MgO and was then subjected to final annealing by heating to 1200° C. at the rate of 5° C./hr in an atmosphere of 25% $N_2$ and 75% $H_2$ followed by holding at 1200° C. for 20hours in a 100% $H_2$atmosphere.

Following the decarburization annealing, an image analyzer was used to measure the average diameter $\bar{d}$ and the coefficient of diameter deviation σ* over the full sectional thickness of each decarburization-annealed strip. Table 6shows the processing conditions, the results of the image analysis and the magnetic flux density of the final products made from the decarburization annealed strip.

TABLE 6

| Decarburization annealing temp. (°C.) | Average diameter $\bar{d}$ (μm) | Coefficient of diameter deviation σ* | Flux density $B_8$(T) | Secondary recrystallization ratio (%) | Remarks |
|---|---|---|---|---|---|
| 810 | 14 | 0.55 | 1.84 | 100 | Comparison |
| 850 | 16 | 0.57 | 1.88 | 100 | Invention |
| 890 | 18 | 0.63 | 1.75 | 71 | Comparison |

By controlling the average diameter $\bar{d}$ of the primary recrystallization grains of the decarburization-annealed strip to be not less than 15μm and also controlling the coefficient of diameter deviation σ* of the primary recrystallization grains of the decarburization-annealed strip to be not more than 0.6, the present invention enables stable production of grain-oriented electrical steel strip with excellent electrical properties. Moreover the invention enables the average diameter $\bar{d}$ and the coefficient of diameter deviation $\sigma^*$ of the primary recrystallization grains of the decarburization-annealed strip to be used as parameters for predicting the magnetic flux density of the final product and, therefore, by adjusting the conditions in the ensuing final annealing step it becomes possible to adjust the magnetic flux density of the final product made from the decarburization annealed strip.

What is claimed is:

1. A method of producing a grain-oriented electrical steel strip exhibiting superior magnetic properties comprising the steps of heating a slab for a grain-oriented electrical steel strip, which slab contains 0.025 –0.100% C and 2.5 –4.5% Si and, as inhibitor-forming elements, at least one element selected from the group consisting of Al, N, Mn, S, Se, Sb, B, Cu, Bi, Nb, Cr, Sn and Ti, to a temperature not exceeding 1300° C., hot rolling the heated slab to obtain a hot rolled strip, cold rolling the hot rolled strip at a final reduction [ration] ratio of not less than 80% in a single pass or two or more passes with intermediate annealing being performed between passes, subjecting the cold rolled strip to decarburization annealing to impart it with an average primary recrystallization grain diameter d of not less than 15μm and not more than 50μm and a coefficient of primary recrystallization diameter deviation $\theta^*$ of not more than 0.6, nitriding or sulfiding the decarburization-annealed strip after completion of decarburization annealing but not later than the start of secondary recrystallization to increase its AlN or MnS inhibitor strength, and finish annealing the inhibitor-strengthened strip the secondary recrystallization occurring during finish annealing conducted following the decarburization annealing.

* * * * *